US007965025B2

(12) United States Patent
Dianqing

(10) Patent No.: US 7,965,025 B2
(45) Date of Patent: Jun. 21, 2011

(54) LIGHT STRING WITH IMPROVED SHUNT SYSTEM

(76) Inventor: Zheng Dianqing, Guangdong (CN)

( * ) Notice: Subject to any disclaimer, the term of this patent is extended or adjusted under 35 U.S.C. 154(b) by 258 days.

(21) Appl. No.: 12/383,934

(22) Filed: Mar. 30, 2009

(65) Prior Publication Data

US 2010/0039019 A1 Feb. 18, 2010

(51) Int. Cl.
*H01K 1/14* (2006.01)

(52) U.S. Cl. ..... 313/315; 313/318.05; 439/188

(58) Field of Classification Search ..... 313/315, 313/318.01, 318.05, 573, 493, 634, 635, 313/317; 362/652–655, 249.14, 249.16, 362/249.19; 439/188

See application file for complete search history.

(56) References Cited

U.S. PATENT DOCUMENTS

| | | | |
|---|---|---|---|
| 932,139 | A | 8/1909 | Kempton |
| 1,536,332 | A | 5/1925 | Dam |
| 2,984,813 | A | 5/1961 | Bossi |
| 3,286,088 | A | 11/1966 | Ahroni |
| 3,522,579 | A | 8/1970 | Matsuya |
| 4,720,272 | A | 1/1988 | Durand |
| 5,139,343 | A | 8/1992 | Lin |
| 5,281,158 | A | 1/1994 | Lin |
| 5,453,664 | A | 9/1995 | Harris |
| 5,791,940 | A | 8/1998 | Chen et al. |
| 5,807,134 | A | 9/1998 | Hara |
| 5,816,862 | A | 10/1998 | Tseng |
| 5,839,819 | A | 11/1998 | Pan |
| 5,860,830 | A | 1/1999 | Wu |
| 6,257,740 | B1 | 7/2001 | Gibboney, Jr. |
| 6,533,437 | B1 | 3/2003 | Ahroni |
| 6,783,383 | B1 | 8/2004 | Gibboney |
| 6,929,383 | B1 | 8/2005 | Janning |
| 7,264,392 | B2 | 9/2009 | Massabki et al. |
| 7,581,870 | B2 | 9/2009 | Massabki et al. |
| 2007/0297196 | A1 | 12/2007 | Massabki et al. |

FOREIGN PATENT DOCUMENTS

| | | |
|---|---|---|
| CN | 22535244 | 4/1997 |

*Primary Examiner* — Nimeshkumar D Patel
*Assistant Examiner* — Donald L Raleigh
(74) *Attorney, Agent, or Firm* — Brian K. Johnson, Esq., LLC.

(57) ABSTRACT

This utility model relates to a decorative light, and particularly, to a decorative light capable of avoiding an open circuit condition on an entire string of bulbs that operate in series when an individual bulb is removed. The decorative light comprises a socket, a bulb base, a bulb and two terminals, wherein the socket is provided with a retainer therein, which has an opening laterally extending therethrough, and an elastic conductive ring with a thickness smaller than a width of the opening is disposed within the opening. When the elastic ring is in a natural state, the elastic ring extends outside the retainer through the opening at two sides of the retainer. The bulb base is further provided with an inserting partition at the bottom thereof. The elastic conductive ring has two states: one is a separating state where the bulb base is inserted into the socket. In this first state, the inserting partition of the bulb base separates one side of the elastic ring from the corresponding terminals. The other state is a conducting state of the two terminals when the bulb base is removed from the socket. In this second state both sides of the elastic conductive ring provide with the two terminals respectively. This utility model provides a decorative light capable of preventing failure of the complete string of bulbs when any bulb is removed.

11 Claims, 1 Drawing Sheet

LIGHT STRING WITH IMPROVED SHUNT SYSTEM

CROSS-REFERENCES TO RELATED APPLICATIONS

This application claims priority under 35 USC §119 from Chinese patent application Ser. No. 200820146495.9 filed on Aug. 18, 2008, entitled A DECORATIVE LIGHT, the disclosure and application of which are incorporated by reference herein in its entirety.

TECHNICAL FIELD

This utility model relates to a decorative light, and particularly a decorative light capable of avoiding an open circuit condition on an entire string of bulbs that operate in series when an individual bulb is removed.

TECHNICAL BACKGROUND

In the prior holiday lights, a number of small low-voltage bulbs connected in series are lit up simultaneously. Due to the serial connection, a blown fuse or the removal of one or more of the bulbs will interrupt the complete series circuit connection. To solve this problem, China Patent CN2253524Y discloses a bulb with a resistance wire that can complete the circuit when the bulb's tungsten filament is fused, so as not to affect normal operation of other bulbs. However, according to the technology disclosed in the China Patent CN2253524Y, the resistance wire or fuse is disposed within the bulb, so when one bulb in a decorative light string consisting of such bulbs comes off, an open circuit will still occur, causing the entire string of bulbs to go out.

SUMMARY OF THE INVENTION

One object of this utility model is to overcome the aforesaid drawbacks of the prior art by providing a decorative light capable of preventing failure of the complete string of bulbs when an individual bulb is removed or burns out.

Another object of this utility model is to provide a decorative light that is easy to assemble.

A third object of this utility model is to provide a decorative light that ensures reliable conductive connection by having a conductive device in a socket make full contact with the terminals when a bulb comes off.

The objects of this utility model can be achieved by the following solutions:

A decorative light comprising a socket, a bulb base, a bulb and two terminals, wherein the bulb is disposed on the bulb base, with two electrodes of the bulb passing through the bulb base to form two contacts at the bottom of the bulb base; the socket is shaped like a barrel, the bulb base is inserted into a top end of the bulb base, and the two terminals are inserted into a bottom end of the socket, with the two contacts contacting against the two terminals, the decorative light being characterized in that: the socket is further provided with a retainer therein, which has an opening laterally extending therethrough, and an elastic conductive ring with a thickness smaller than a width of the opening is disposed within the opening; when the elastic ring is in a natural state, the elastic ring extends outside the retainer through the opening at two sides of the retainer; the bulb base is further provided with an inserting partition at the bottom thereof; the elastic conductive ring has two states: one is a separating state where the bulb base is inserted into the socket, in which state the inserting partition of the bulb base separates one side of the elastic ring from corresponding terminals; the other is a conducting state of the two terminals when the bulb base comes off from the socket, in which state both sides of the elastic conductive ring contact against the two terminals respectively.

The decorative light is characterized in that: within the opening of the retainer are formed with an upper and a lower protrusion for limiting vertical movement of the elastic conductive ring.

The decorative light is characterized in that an arc-shaped surface corresponding to an outer circular perimeter of the elastic conductive ring is formed on the bottom of the opening of the retainer.

The decorative light is characterized in that: the retainer is an assembled part that is divided into two detachable portions by the opening.

The decorative light is characterized in that: within the opening of the retainer are formed with an upper and a lower protrusion for limiting vertical movement of the elastic conductive ring; an arc-shaped surface corresponding to an outer circular perimeter of the elastic conductive ring is formed on the bottom of the opening of the retainer; and the retainer is an assembled part that is divided into two detachable portions by the opening.

The decorative light is characterized in that the bulb is either an LED bulb or an incandescent bulb.

As compared to the prior art, when an individual bulb is removed from the bulb base in the decorative light of this utility model, the elastic conductive ring can complete the circuit connection reasonably immediately due to the expansion of the ring so as not to affect operation of the whole string of bulbs. The elastic conductive ring may be pre-mounted into the retainer and then the retainer incorporating the elastic conductive ring as a whole is fitted into the socket. Therefore, the decorative light of this invention has a feature that it is easy to assemble. In case the bulb base and the bulb come off from the socket, the elastic conductive ring will make contact with the terminals at both sides. Moreover, the decorative light of this invention features reliable conductive connection without false contact and arcing. Because decorative lights are often moved by the wind or moved around by the user, this feature makes the decorative light safer for use.

DETAILED DESCRIPTION OF THE INVENTION

Figure 1:
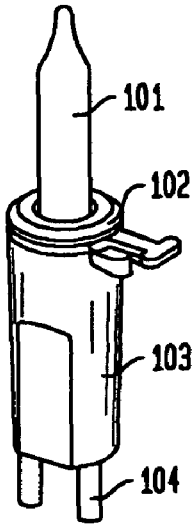
FIG. 1 is a schematic view of a first embodiment of the present invention.
Figure 2:
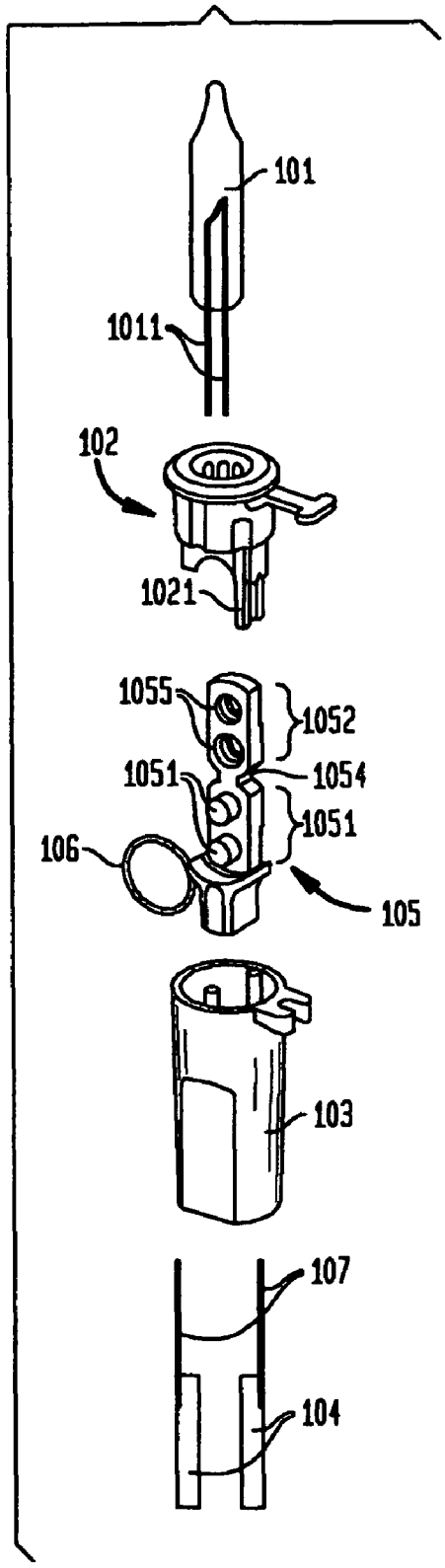
FIG. 2 is a schematic exploded view of the first embodiment of the present invention.

Hereinafter, this utility model will be further described with reference to the drawings. Referring to FIGS. 1 and 2, a first embodiment of the present invention is a decorative light comprising a socket 103, a bulb base 102, a bulb 101 and two terminals 107. The bulb 101 is disposed on the bulb base 102, with two electrodes 1011 of the bulb 101 passing through the bulb base 102 to form two contacts at the bottom of the bulb base 102. The socket 103 is shaped like a barrel, the bulb base 102 is inserted into the top end of the bulb base 103, and the two terminals 107 are inserted to the bottom end of the socket, with the two contacts at the bottom of the bulb base 102 contacting against the two terminals 107 respectively. The terminals 107 are pressed to corresponding power leads 104. The socket 103 is further provided with a retainer 105 therein, which has an opening laterally extending therethrough and an elastic conductive ring 106 disposed within the opening. A thickness of the elastic conductive ring 106 is smaller than a width of the opening so that the elastic conductive ring 106 can move laterally within the opening. When the elastic ring 106 is in a natural state, the elastic conductive ring 106 extends outside the retainer 105 through the opening at both sides of the retainer 105 respectively. The bulb base 102 is further provided with an inserting partition 1021 at the bottom thereof. The elastic conductive ring 106 has two states: the first is a separating state where the bulb base 102 is inserted into the socket 103, in which state the inserting partition 1021 of the bulb base 102 separates one side of the elastic ring 106 from a corresponding terminal 107. The second state is a conducting state of the two terminals 107 when the bulb base 102 comes off from the socket 103 (i.e. the light bulb is removed), in which state both sides of the elastic conductive ring 106 contact against the two terminals 107 respectively. An upper and a lower protrusion 1051 for limiting vertical movement of the elastic conductive ring are provided inside of the opening of the retainer 105. The elastic conductive ring 106, when assembled, encircles the two protrusions 1051 so as to limit vertical movement of the elastic conductive ring 106 by means of the two protrusions 1051. The elastic conductive ring 106 is allowed to make a slight movement in the lateral direction to provide for elasticity. On the bottom of the opening of the retainer 105 is an arc-shaped surface corresponding to an outer circular perimeter of the elastic conductive ring 106, so as to render the elastic conductive ring 106 more stable within the retainer and easy to be assembled. In this embodiment, the retainer 105 is an assembled part that is divided into two detachable portions by the opening, and the two portions are joined by an elastic plastic piece at the top of the opening so that, with the elastic plastic piece as a hinge, the two portions can be separated from each other to a certain extent at the opposite side, thereby allowing assembly of the elastic conductive ring 106. To clarify, the opening is formed between sections 1052 and 1053 when section 1052 of retainer 105 is bent down at hinge 1054 such that protrusions 1051 insert into holes 1055. When there are the bulb base 102 and the bulb 101 are assembled, the inserting partition 1021 of the bulb base is inserted through between the side of the elastic conductive ring 106 and the terminals 107, and the elastic conductive ring 106 is shaped into an elliptical form. In this arrangement the two terminals 107 are not connected to each other and power is supplied to bulb 101 through electrodes 1011. However, when the bulb base 102 and the bulb 101 are removed from the socket 103, the elastic conductive ring 106 will substantially restore the circular form under action of its elasticity. To ensure a contact pressure between the elastic conductive ring 106 and the two terminals 107, the elastic conductive ring 106 is slightly deformed. In this arrangement, the elastic conductive ring 106 contacts against both the two terminals 107 to connect them directly together.

What is claimed is:

1. A decorative light comprising a socket, a bulb base, a bulb and two terminals, wherein the bulb is disposed on the bulb base, with two electrodes of the bulb passing through the bulb base to form two contacts at the bottom of the bulb base; the socket is shaped like a barrel, the bulb base is inserted into a top end of the socket, and the two terminals are inserted into a bottom end of the socket, with the two contacts contacting against the two terminals, the decorative light being characterized in that the socket is further provided with a retainer therein, which has an opening laterally extending therethrough, and an elastic conductive ring with a thickness smaller than a width of the opening is disposed within the opening; when the elastic ring is in a natural state, the elastic ring extends outside the retainer through the opening at two sides of the retainer; the bulb base is further provided with an inserting partition at the bottom thereof; the elastic conductive ring has two states: one is a separating state where the bulb base is inserted into the socket, in which state the inserting partition of the bulb base separates one side of the elastic ring from the corresponding terminals thereby allowing electrical contact through the bulb from the terminals; the other is a conducting state of the two terminals when the bulb base is removed from the socket, in which state both sides of the elastic conductive ring contact against the two terminals respectively to provide electrical contact between them.

2. The decorative light as claimed in claim 1, being characterized in that: within the opening of the retainer are disposed an upper and a lower protrusion for limiting vertical movement of the elastic conductive ring.

3. The decorative light as claimed in claim 1, being characterized in that: an arc-shaped surface corresponding to an outer circumference of the elastic conductive ring is formed on the bottom of the opening of the retainer.

4. The decorative light as claimed in claim 1, being characterized in that: the retainer is an assembled part that is divided into two detachable portions by the opening.

5. The decorative light as claimed in claim 1, being characterized in that: within the opening of the retainer are formed with an upper and a lower protrusion for limiting vertical movement of the elastic conductive ring; an arc-shaped surface corresponding to an outer circular perimeter of the elastic conductive ring is formed on the bottom of the opening of the retainer; and the retainer is an assembled part that is divided into two detachable portions by the opening.

6. The decorative light as claimed in claim 1, being characterized in that the bulb is either an LED bulb or an incandescent bulb.

7. A light holder for providing electrical connection between two light string terminals, said light holder comprising:

a retainer having a protrusion;

an electrically conductive deformable ring disposed within said retainer, said ring being limited in movement within said ring by said protrusion, said ring being in electrical contact with both of said terminals when no light bulb is inserted into said light holder, said ring being deformed so as to break said electrical contact with said terminals when a light is inserted into said light holder such that the electrical connection between the terminals takes place through said bulb.

8. The light holder of claim 7 wherein said protrusion limits the movement of said conductive ring along a central axis of said light holder.

9. The light holder of claim 7 wherein retainer further comprises a deformable portion for securing said ring in fixed relationship to said protrusion.

10. A light holder for providing electrical connection between two light string terminals; said light holder comprising:

an socket having a retainer and a recessed volume;

an elastic, electrically conductive ring mounted within said retainer; said ring having two sides; one side of said ring being in fixed contact with one of said light string terminals; the other side of said ring being in contact with the other of said light string terminals when no light bulb is present in said holder so that as to electrically connect the two light string terminals through said ring; one side of said ring being displaced and disengaged from said other of said light string terminals when a light bulb is present in said holder so as to electrically connect the two light string terminals through said light bulb.

11. The light holder of claim 10 further comprising a socket containing said light bulb, said socket having a said light bulb includes an inserting partition, said ring being capable of being displaced in a plurality of locations by said inserting portion so as to disengage from said other of said light string terminals when said socket containing said light bulb is present in said holder.

* * * * *